US011647843B2

(12) United States Patent
Lou

(10) Patent No.: US 11,647,843 B2
(45) Date of Patent: May 16, 2023

(54) MULTIFUNCTIONAL SOFA

(71) Applicant: UE FURNITURE CO., LTD, Zhejiang (CN)

(72) Inventor: Jun Lou, Zhejiang (CN)

(73) Assignee: UE FURNITURE CO., LTD, Zhejiang (CN)

( * ) Notice: Subject to any disclaimer, the term of this patent is extended or adjusted under 35 U.S.C. 154(b) by 0 days.

(21) Appl. No.: 17/562,027

(22) Filed: Dec. 27, 2021

(65) Prior Publication Data

US 2022/0202193 A1 Jun. 30, 2022

(30) Foreign Application Priority Data

Dec. 30, 2020 (CN) ..... 202023277780.4
Apr. 1, 2021 (CN) ..... 202120675659.2

(51) Int. Cl.
*A47C 17/86* (2006.01)
*A47C 17/04* (2006.01)

(52) U.S. Cl.
CPC ..... *A47C 17/86* (2013.01); *A47C 17/04* (2013.01)

(58) Field of Classification Search
CPC ..... A47C 17/86; A47C 17/04
USPC ..... 297/112
See application file for complete search history.

(56) References Cited

U.S. PATENT DOCUMENTS 1,907,322 A * 5/1933 Keicher ..... A47C 7/70 297/145
5,106,153 A * 4/1992 Durling ..... A47C 7/624 297/188.17
5,848,821 A * 12/1998 Kirby ..... A47C 17/04 297/232
D882,981 S * 5/2020 Dix ..... D6/381
10,681,987 B2 * 6/2020 Liu ..... A47C 31/008
10,736,429 B2 * 8/2020 Kang ..... E05B 65/46
2009/0152915 A1 * 6/2009 Krasna ..... A47C 7/624 297/217.3
2013/0249256 A1 * 9/2013 Payne, Jr. ..... A47C 7/624 297/161

FOREIGN PATENT DOCUMENTS

CN 105919338 * 9/2016

* cited by examiner

*Primary Examiner* — Mark R Wendell
(74) *Attorney, Agent, or Firm* — JCIPRNET

(57) ABSTRACT

A multifunctional sofa includes armrest assemblies and seat units. A middle armrest is arranged between the adjacent seat units, and a front end of the middle armrest is provided with a cupholder. An upper end surface of the cupholder is provided with a cup slot, and an outer cover is also provided outside the cupholder. The outer cover may rotate relative to the cupholder to allow the one cup slot to be unfolded or folded. A movable function rack capable of rotating outwards relative to the armrest assembly is arranged in each of armrest assemblies. The movable function rack is provided with a function table. In the hidden position, the movable function rack is entirely located in the accommodating groove. In the use position, the movable function rack rotates outwards from the accommodating groove to protrude from the armrest assembly, and the function table is exposed outside.

10 Claims, 11 Drawing Sheets

MULTIFUNCTIONAL SOFA

CROSS-REFERENCE TO RELATED APPLICATION

This application claims the priority benefit of China application serial no. 202023277780.4, filed on Dec. 30, 2020, and China application serial no. 202120675659.2, filed on Apr. 1, 2021. The entirety of each of the above-mentioned patent applications is hereby incorporated by reference herein and made a part of this specification.

BACKGROUND

Technical Field

The disclosure relates to the field of furniture, and in particular, relates to a multifunctional sofa.

Description of Related Art

A sofa is a multi-seat chair with cushions, and there are armrests on both sides of the sofa. The sofa is a kind of upholstered furniture and is often used in VIP receptions or high-standard conference rooms. Tea cabinets are often placed on the sides close to the armrests of the sofa to allow a user to place his/her tea cup or personal items conveniently. However, the tea cabinets occupy large areas and may not be moved conveniently, so some sofas on the market are quipped with cupholders and storage grooves on the armrests to solve this problem.

An existing armrest cupholder is basically arranged on the upper surface of the armrest and is exposed to the outside to allow a tea cup to be conveniently picked up and placed. Such a design allows a user to enjoy a convenient using experience and allows a sofa to provide more functions. However, since the cupholder and the storage groove are both exposed outside, the overall appearance and shape of the sofa are affected, and poor privacy is provided. Especially for some sofas with soft armrests, the cupholders or storage grooves designed to be arranged on the upper surfaces of the soft armrests may undoubtedly affect the overall shape and appearance of the sofas.

SUMMARY

Aiming to overcome the shortcomings found in the related art, the disclosure provides a multifunctional sofa. A front end of a middle armrest of the sofa in a middle position is provided with a cupholder with a cup slot. An outer cover capable of covering or exposing the cup slot is arranged outside the cupholder, so that the cup slot may be hidden and may be selectively unfolded or folded according to actual needs from a user. Each of armrest assemblies on both sides of the sofa is provided with a movable function rack. The movable function rack may be hidden in the armrest assembly or may be rotated to be exposed outside the armrest assembly. The movable function rack is provided with a function table, and the function table is provided with at least one first function area and at least one second function area. The first function area and the second function area may be provided with a cup slot or a storage groove that is convenient for the user to use. In this way, when the user uses the sofa, the user may easily place his/her water cup or personal belongings on the sofa to enjoy the human-centered design and the multiple functions provided by the sofa. Further, the cupholder and the movable function rack may both be selectively hidden or unfolded according to user's personal needs, and in this way, the sofa may not only provide multiple functions but also exhibit a favorable appearance.

Technical solutions provided by the disclosure are implemented through the following manners.

A multifunctional sofa is provided, and the multifunctional sofa includes armrest assemblies located on both sides and at least two seat units. A middle armrest is arranged between the at least two adjacent seat units, and a front end of the middle armrest is provided with a cupholder. An upper end surface of the cupholder is provided with at least one cup slot for placing a cup, and an outer cover is also provided outside the cupholder. The outer cover may rotate relative to the cupholder to allow the at least one cup slot to be unfolded or folded. An accommodating groove is arranged in each of the armrest assemblies, and a movable function rack which can rotate outwards relative to the armrest assembly is arranged in the accommodating groove. The movable function rack is provided with a function table, and the function table is provided with at least one first function area and at least one second function area. The movable function rack has a hidden position and a use position. In the hidden position, the movable function rack is entirely located in the accommodating groove. In the use position, the movable function rack rotates outwards from the accommodating groove to protrude from the armrest assembly, and the function table is exposed outside.

The disclosure adopting the above technical solutions exhibits the following design starting point, concepts, and beneficial effects.

First, by arranging the cupholder with the at least one cup slot on the middle armrest and arranging the outer cover that can rotate relative to the cupholder outside the cupholder, the outer cover may be rotated to make the at least one cup slot to be unfolded or folded. By arranging the movable function rack in the armrest assembly and arranging the function table at the upper end of the movable function rack to be provided with the cup slot and the storage slot, the movable function rack may also be rotated to be in the hidden position or in the use position. In this way, when the user uses the sofa, the user may easily place his/her water cup or personal belongings on the cupholder or the function table to enjoy the convenient design and the multiple functions provided by the sofa. Further, the cupholder and the movable function rack may both be selectively used or hidden according to user's personal needs, and in this way, the sofa may not only provide multiple furniture functions but also exhibit a simple and favorable appearance.

Further, in some conventional sofas, the cupholder is arranged on the upper surface of the armrest, so that the sofa may allow placement of a water cup. However, this undoubtedly limits the appearance of the sofa, and the upper surface of the armrest cannot be wrapped or soft-packed. In the multifunctional sofa provided by the disclosure, by arranging the outer cover outside the cupholder, the outer cover may be rotated to allow the cupholder to be folded. In this way, the appearance of the furniture may not be affected, and a favorable appearance is provided. Further, by arranging the movable function rack inside the armrest assembly, the upper surface of the armrest assembly may still be wrapped or soft-packed without interfering with the style of the sofa itself.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
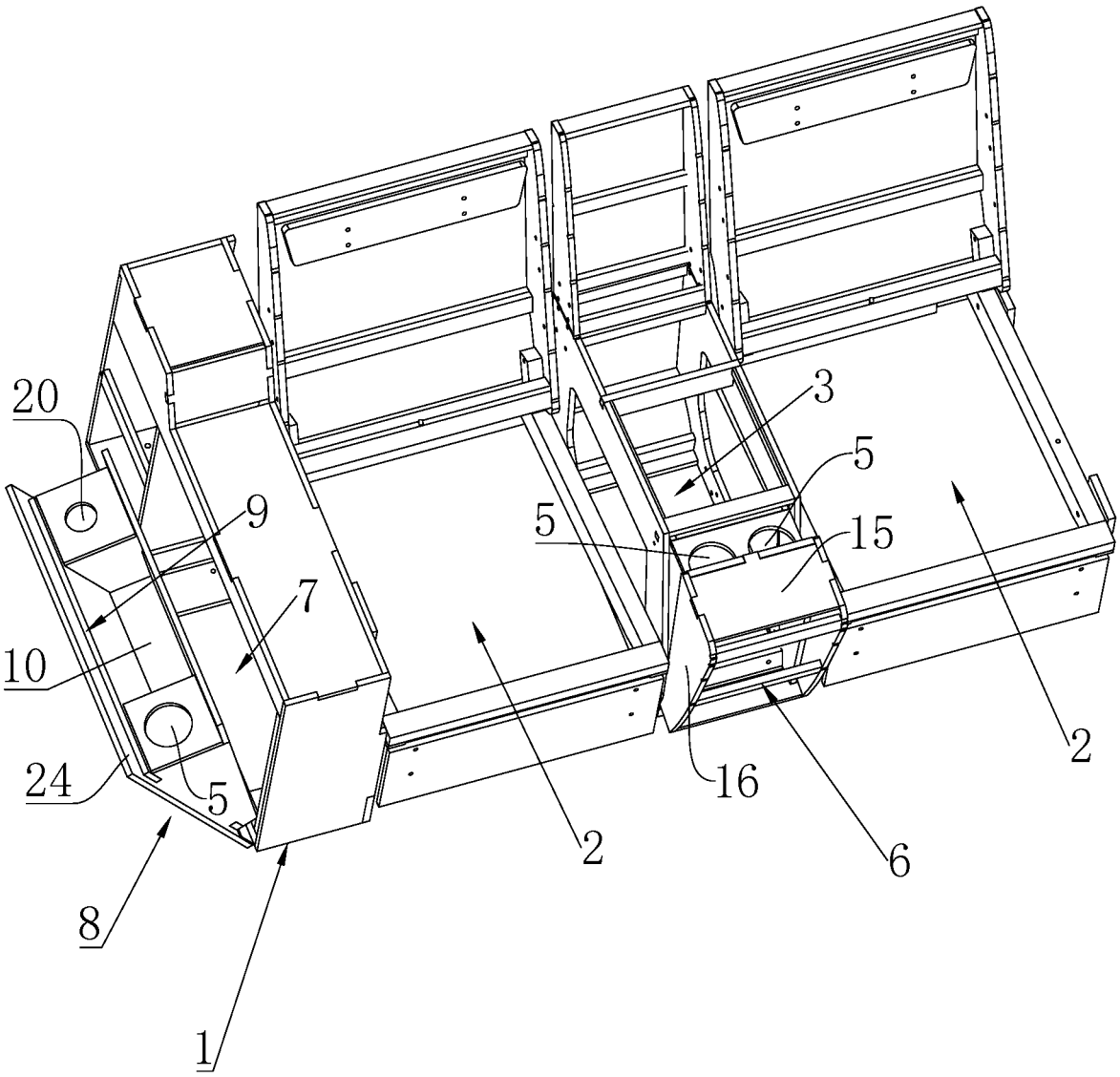
FIG. 1 is a three-dimensional schematic view of a structure of a sofa according to an embodiment of the disclosure.

To better illustrate the above objectives, features, and advantages of the disclosure, the disclosure is further described in detail below in combination with the accompanying drawings and specific embodiments. Note that the embodiments of the disclosure and the features in the embodiments may be combined with each other with no absence of conflict.

In the description provided as follows, many specific details are explained in order to fully understand the disclosure. However, the disclosure may also be implemented in other ways different from those described herein. Therefore, the protection scope of the disclosure is not limited by the specific embodiments disclosed below.

In the description of the disclosure, the term "at least one" refers to one or more than one unless specifically defined otherwise. The terms "first", "second", "third", etc. are only used for descriptive purposes and cannot be understood as indicating or implying relative importance.

The vocabulary of various positions involved in this embodiment, such as front, back, etc., is described in a usage state where the user is actually sitting on the sofa.

Specific embodiments of the disclosure are provided as follows.

As shown in FIG. 1 to FIG. 11, the disclosure provides a multifunctional sofa including armrest assemblies 1 on the left and right sides and two seat units 2 for the human body to sit on. A middle armrest 3 is also provided between the two adjacent seat units 2, and the middle armrest 3 may be used for partitioning as well as for armrest supporting. A front end of the middle armrest 3 is provided with a cupholder 4, and on an upper surface of the cupholder 4, a pair of cup slots 5 for placing tea cups or water cups are provided. An outer cover 6 is provided outside the cupholder 4, and a lower end of the outer cover 6 is rotatably connected to the middle armrest 3, so the outer cover 6 allows the cupholder 4 to provide an unfolded state or a folded state. In the folded state, the outer cover 6 covers the cupholder 4, and the cup slots 5 are hidden. In the unfolded state, the outer cover 6 rotates outwards to expose the cup slots 5, so the cup slots 5 are of a hidden design. Besides, an accommodating groove 7 is arranged in each of the armrest assemblies 1, a movable function rack 8 is arranged in the accommodating groove 7, and the movable function rack 8 is rotatably connected to the armrest assembly 1. The movable function rack 8 is provided with a function table 9, and the function table 9 is provided with a first function area and a second function area. The first function area is also provided with the cup slot 5 for placing a tea cup or a water cup, and the second function area is provided with a storage groove 10 for placing a mobile phone or other objects. The movable function rack 8 has a use position and a hidden position. In the hidden position, the movable function rack 8 is located in the accommodating groove 7 so that the movable function rack 8 is entirely hidden in the armrest assembly 1. In the use position, the movable function rack 8 rotates outwards from the accommodating groove 7 to protrude from the armrest assembly 1, and the function table 9 is exposed outside, so that the cup slot 5 and the storage groove 10 may be conveniently used by a user. In the multifunctional sofa provided by the disclosure, the cup slots 5 are provided on the middle armrest 3, and the outer cover 6 is further provided to allow the cup slots 5 to be folded or unfolded. The armrest assembly 1 is provided with the movable function rack 8. The movable function rack 8 is provided with the cup slot 5 and the storage groove 10, and the movable function rack 8 may be hidden or unfolded. In this way, when the user sits on the seat unit 2, the user may easily place his/her water cup or personal belongings on the sofa to enjoy the human-centered design provided by the disclosure. Further, the cupholder 4 and the movable function rack 8 may both be selectively hidden or unfolded according to user's personal needs, and in this way, the sofa may not only provide multiple functions but also exhibit a favorable appearance.

Figure 2:
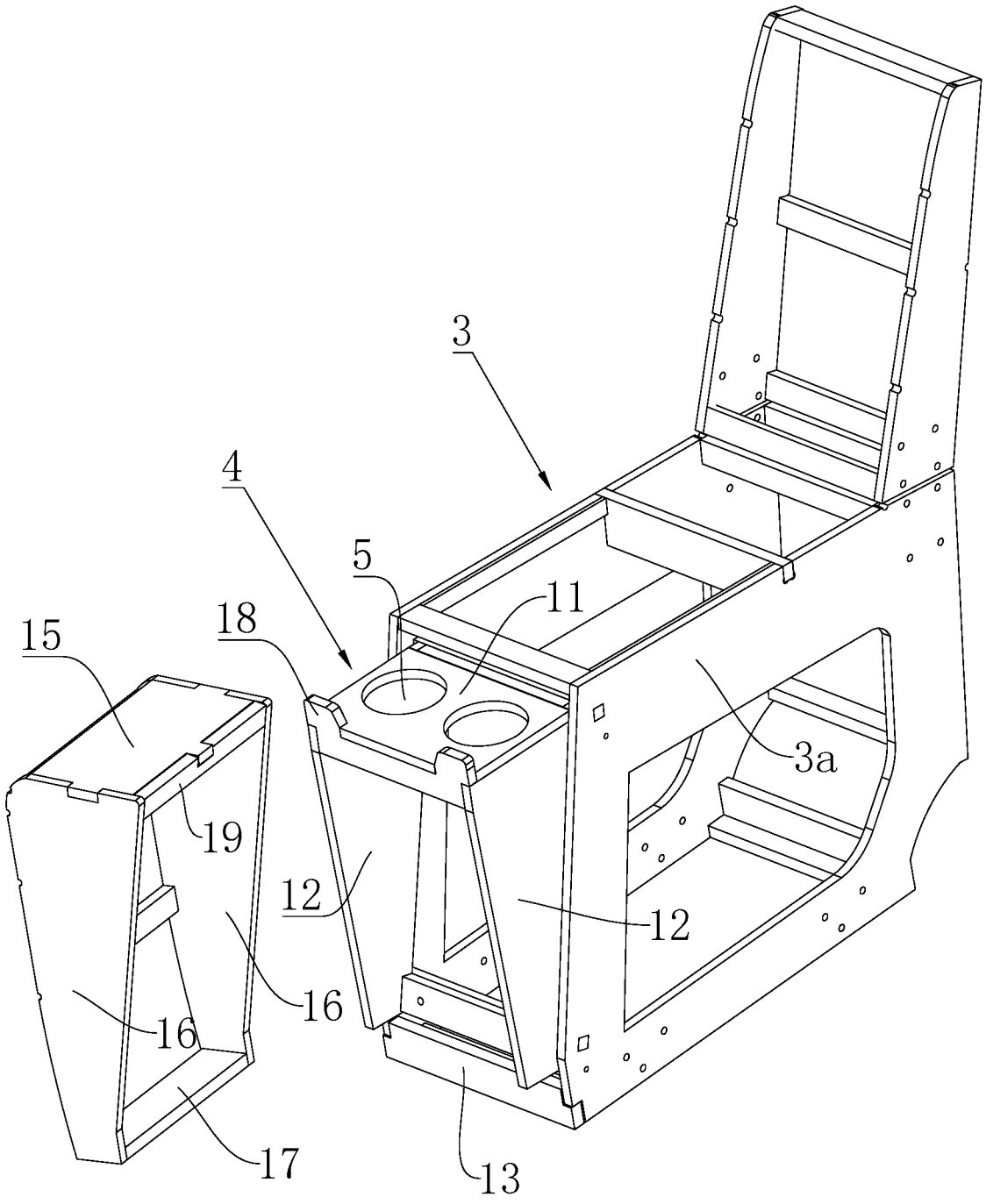
FIG. 2 is a three-dimensional schematic view of a structure when an outer cover and a cupholder are connected according to an embodiment of the disclosure.
Figure 3:
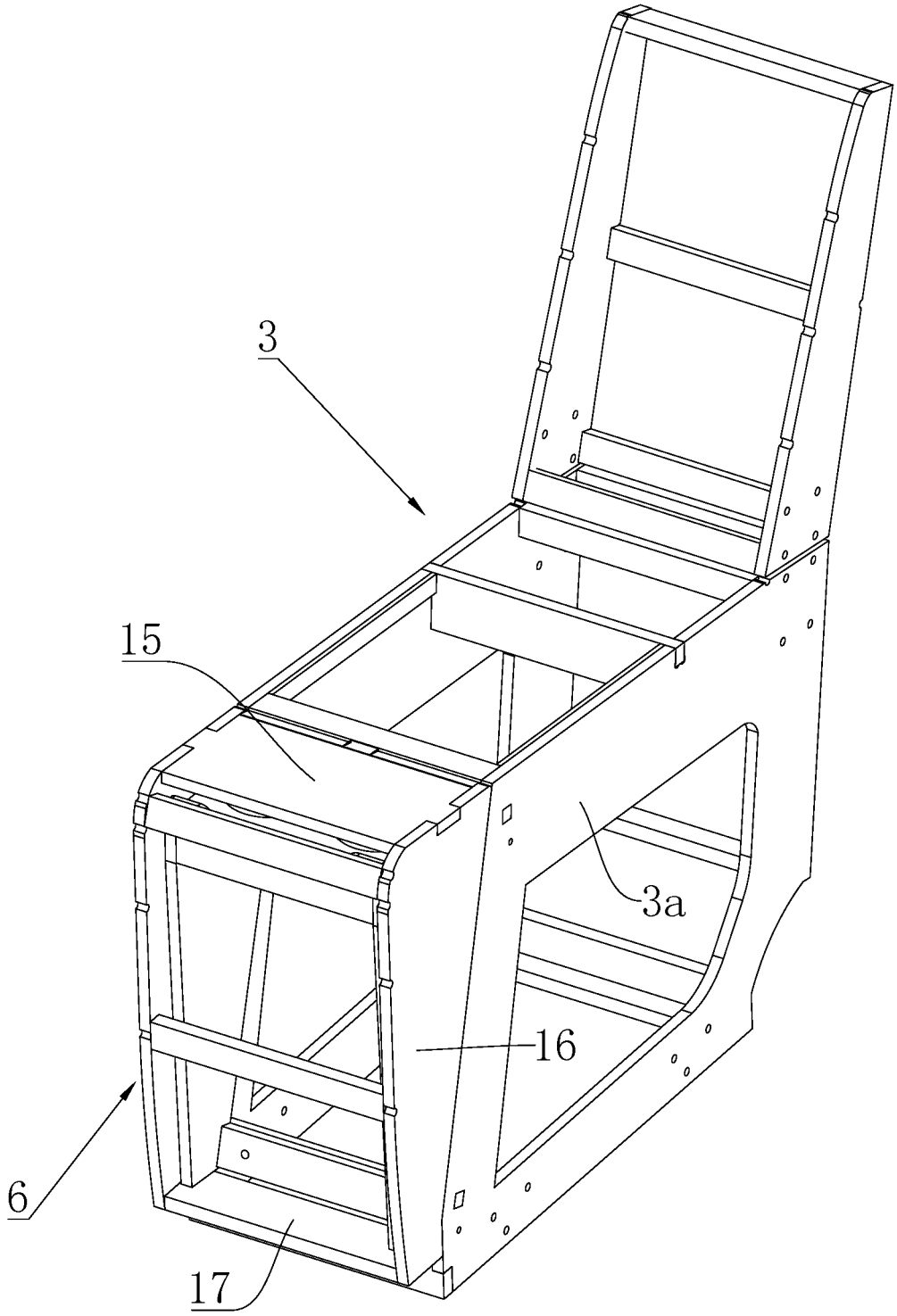
FIG. 3 is a three-dimensional schematic view of the structure of the sofa when the cupholder is in a folded state according to an embodiment of the disclosure.
Figure 4:
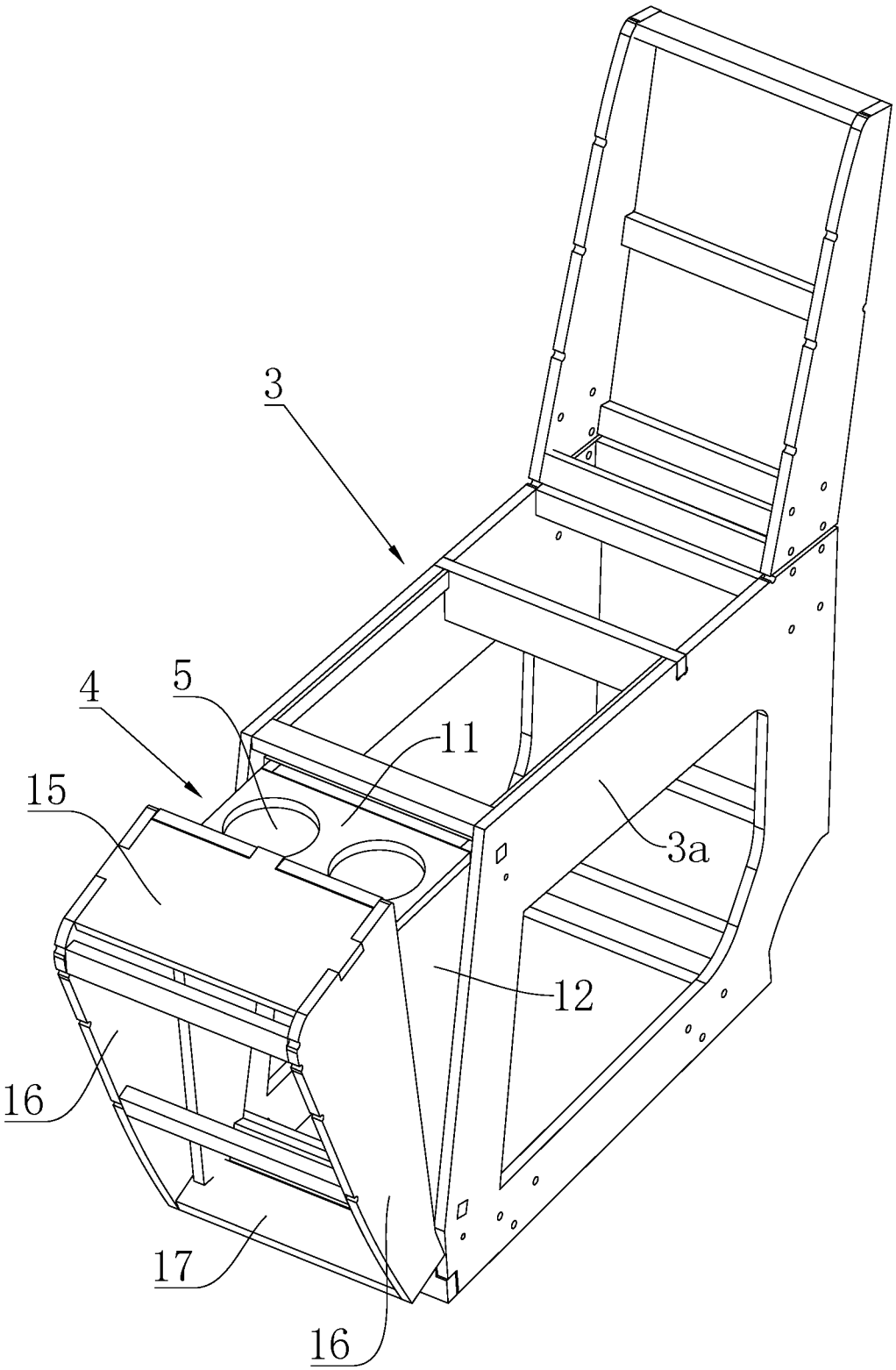
FIG. 4 is a three-dimensional schematic view of the structure of the sofa when the cupholder is in an unfolded state according to an embodiment of the disclosure.
Figure 5:
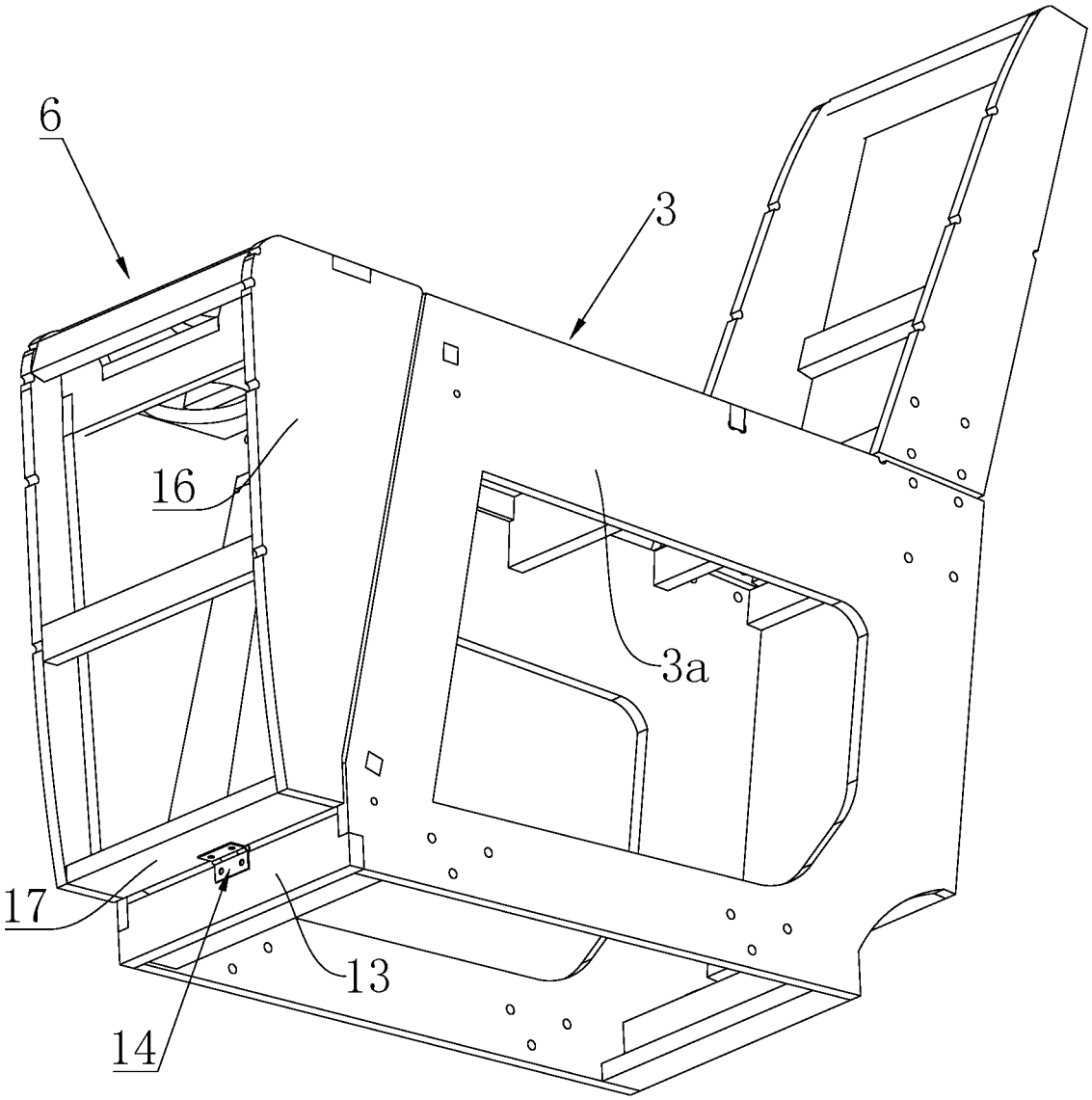
FIG. 5 is a three-dimensional schematic view of a structure when the outer cover and a bottom of a middle armrest are connected according to an embodiment of the disclosure.
Figure 6:
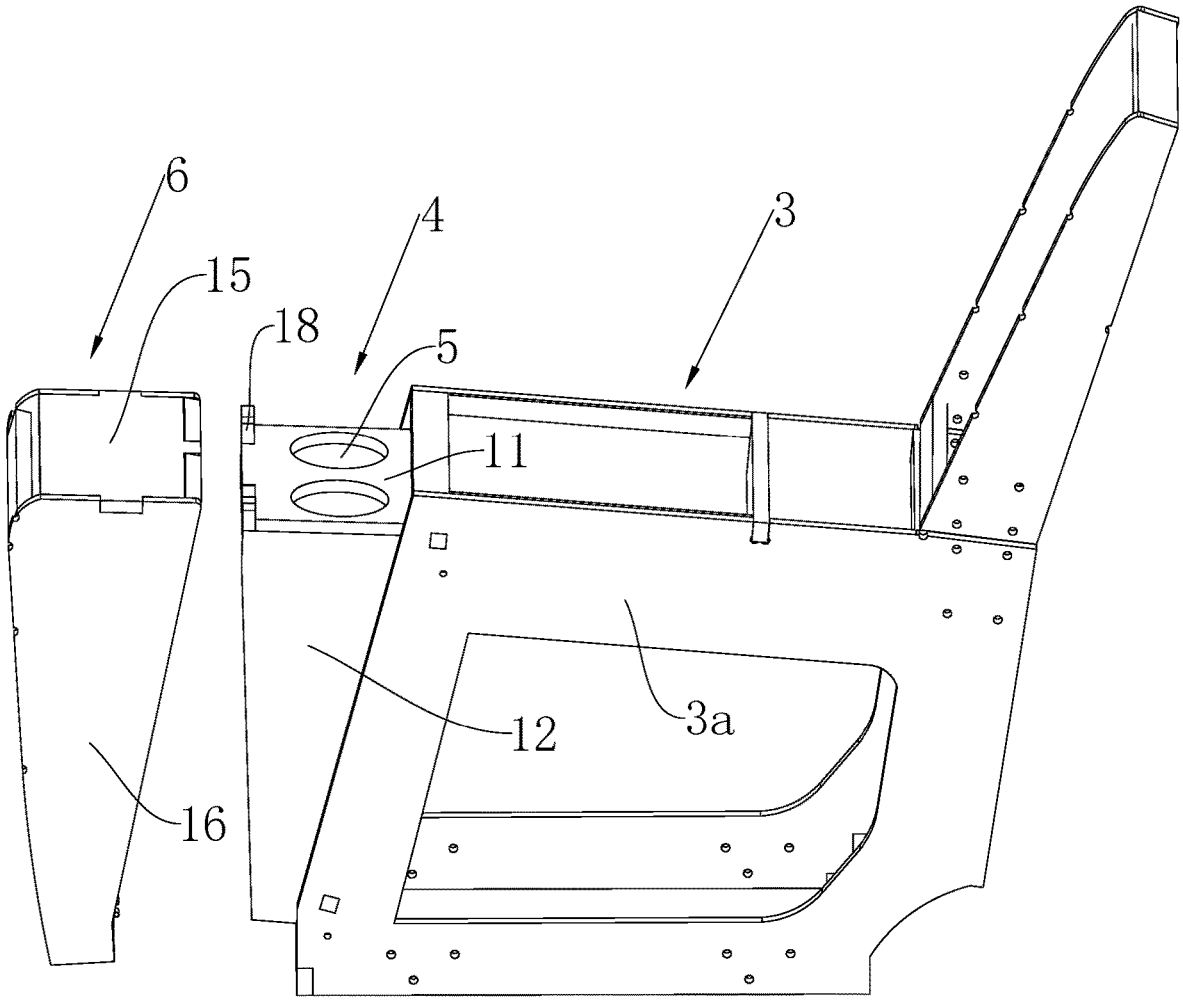
FIG. 6 is a three-dimensional schematic view of a structure of a side surface of the middle armrest according to an embodiment of the disclosure.

As shown in FIG. 1 to FIG. 6, the cupholder 4 is arranged at the front end of the middle armrest 3, so that when the user places his/her arm on the middle armrest 3, the user may easily pick up or place a cup and may also easily rotate the outer cover 6 to allow the cup slots 5 to be exposed or folded. To be specific, the cupholder 4 includes a tray 11 horizontally arranged at the upper end and supporting side plates 12 located on the left and right sides of the tray 11. The cup slots 5 are disposed on the tray 11, the supporting side plates 12 and the middle armrest 3 are fixedly connected, and each of the supporting side plates is in an inverted triangle shape. After the supporting side plates 12 are connected to the middle armrest 3, foremost sides of the supporting side plates 12 are perpendicular to a horizontal plane. In this way, an overall square structure of the middle armrest 3 is maintained, and an overall appearance of the middle armrest 3 is not affected. The middle armrest 3 has a connecting riser 13 at a front lower end, and the connecting riser 13 is located directly below the cupholder 4. A lower end of the outer cover 6 is hinged with the connecting riser 13 through a hinge 14 so that the outer cover 6 may rotate relative to the middle armrest 3 to cover the cupholder 4. To be specific, a shape of the outer cover 6 is matched with a shape of the cupholder 2. The outer cover 6 includes a covering lid 15 located at an upper end and outer side plates 16 located on left and right sides of the covering lid 15, and the cupholder 4 is located between the two outer side plates 16. A connecting horizontal plate 17 is provided between lower ends of the two outer side plates 16. The connecting horizontal plate 17 and the connecting riser 13 are hinged through the hinge 14 so that the lower end of the outer cover 6 may rotate relative to the middle armrest 3. Besides, the middle armrest 3 includes armrest side plates 3*a* located on both sides, and the supporting side plates 12 are connected to inner sides of the two armrest side plates 3*a*. When the outer cover 6 is rotated to completely cover the cupholder 4, as shown in FIG. 3, the outer side plates 16 on both sides of the outer cover 6 may be rotated to be engaged with the armrest side plates 3*a*, and connection between the two is smooth. Herein, the covering lid 15 is in a horizontal state, and the covering lid 15 is located directly above the tray 11 to hide the cup slots 5. In this way, the sofa may provide a favorable appearance, and a shape of the middle armrest 3 itself is maintained.

As such, by rotating the outer cover 6, the cupholder 4 may be hidden or the cupholder 4 may be exposed. As shown in FIG. 3, when the sofa is in a normal use state and no water cup is required to be placed, the outer cover 6 is rotated upwards until the covering lid 15 thereof is in a horizontal state and the two supporting side plates 12 are located between the two outer side plates 16 and overlap with each other. The covering lid 15 is located directly above the tray 11 to cover the cup slots 5, and the cupholder 4 is completely hidden in the outer cover 6. Further, connection between the outer cover 6 and the middle armrest 3 is smooth and thus does not affect the overall appearance of the sofa. As shown in FIG. when the user needs to place a water cup on the middle armrest 3, the user only has to rotate the outer cover 6 forwards to expose the cupholder 4. The cup slots 5 on the cupholder 4 may then be completely exposed, and the user may thereby place the water cup in one of the cup slots 5 to enjoy the multiple functions and the human-centered design provided by the sofa. As shown in FIG. 2, a limiting plate 18 protruding upwards from the tray 11 is provided at the front end of the tray 11, and a baffle 19 facing vertically downwards is correspondingly provided at a rear end of the covering lid 15. When the outer cover 6 rotates forwards to a maximum angle, the baffle 19 may abut against and be matched with the limiting plate 18 to restrict the outer cover 6 from rotating further forwards.

As shown in FIG. 1 and FIG. 7 to FIG. 11, the function table 9 is located at an upper end of the movable function rack 8, and the function table 9 is arranged in a length direction of the armrest assembly 1. The cup slot 5 and the storage groove 10 are sequentially arranged on an upper surface of the function table 9 in a front-rear direction. Besides, a charging slot 20 is also provided on the function table 9. The charging slot 20 is configured to allow installation of a wireless charging pad, so that the user may charge his/her mobile phone while sitting on the sofa to enjoy one of the multiple functions provided by the sofa. The storage groove 10 is located between the cup slot 5 and the charging slot 20.

As shown in FIG. 7 to FIG. 10, a longitudinal section of the movable function rack 8 is triangular, and an outer side of the movable function rack 8 is provided with an outer covering lid 24. In the hidden position, the outer covering lid 24 just fits on an outer side wall 1*a* of the armrest assembly 1, so that the outer covering lid 24 may effectively cover the accommodating groove 7, and a favorable appearance is thereby provided. An inner side of the movable function rack 8 is provided with a convex plate 21 extending upwards and protruding from the function table 9, and at an upper end of the accommodating groove 7, inner and outer sides of the armrest assembly 1 are respectively provided with an inner restricting plate 22 and an outer restricting plate 23 for restricting the convex plate 21. When the movable function rack 8 is switched between the hidden position and the use position, the convex plate 21 is always restricted between the inner restricting plate 22 and the outer restricting plate 23, and an angle of rotation of the movable function rack 8 is thereby effectively restricted.

Figure 11:
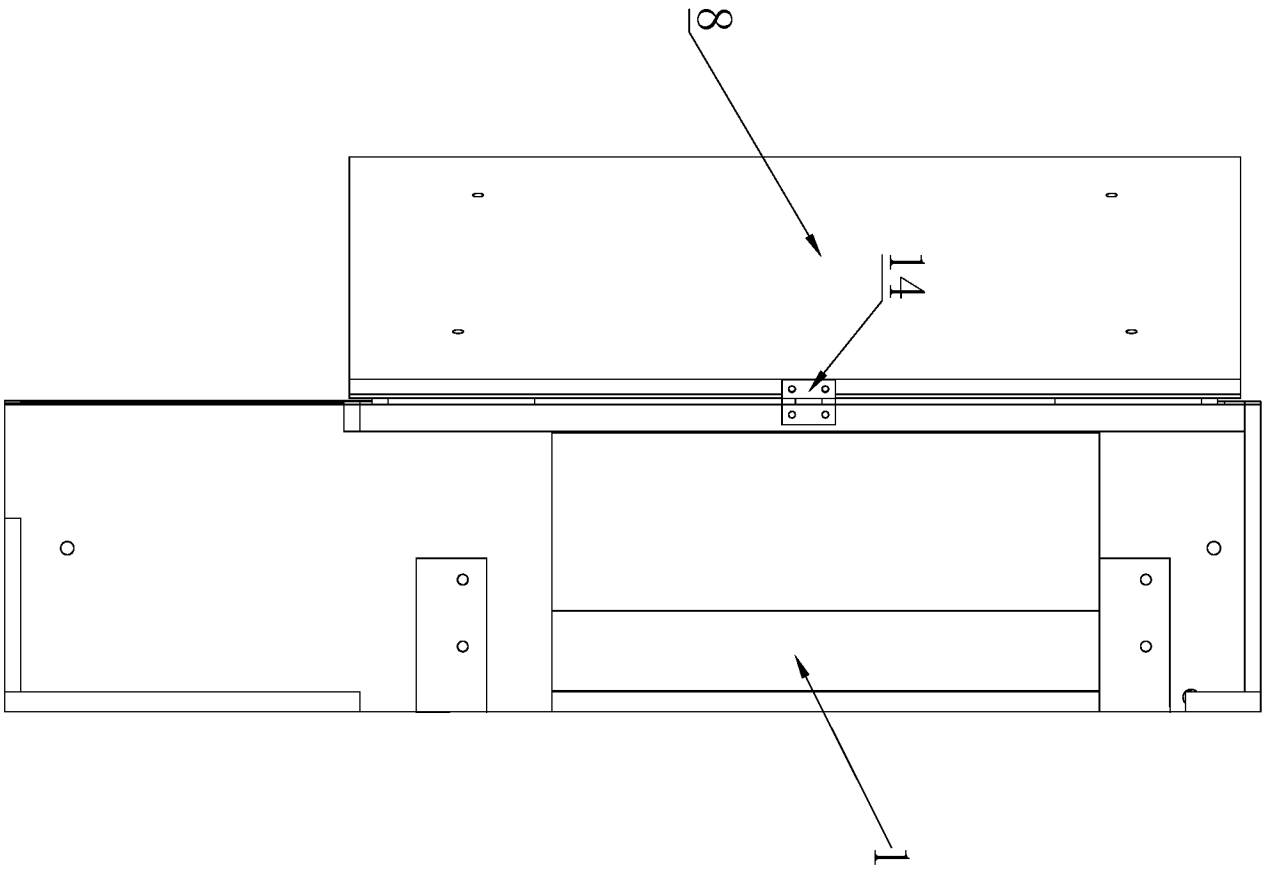
FIG. 11 is a three-dimensional schematic view of a structure when the movable function rack and an armrest assembly are rotatably connected according to an embodiment of the disclosure.

As shown in FIG. 11, a lower end of the movable function rack 8 and a lower end of the armrest assembly 1 are also hinged together by the hinge 14. In this way, the movable function rack 8 may be rotated relative to the armrest assembly 1, and the movable function rack 8 may be conveniently unfolded and hidden and is simple to use in a labor-saving manner.

Figure 7:
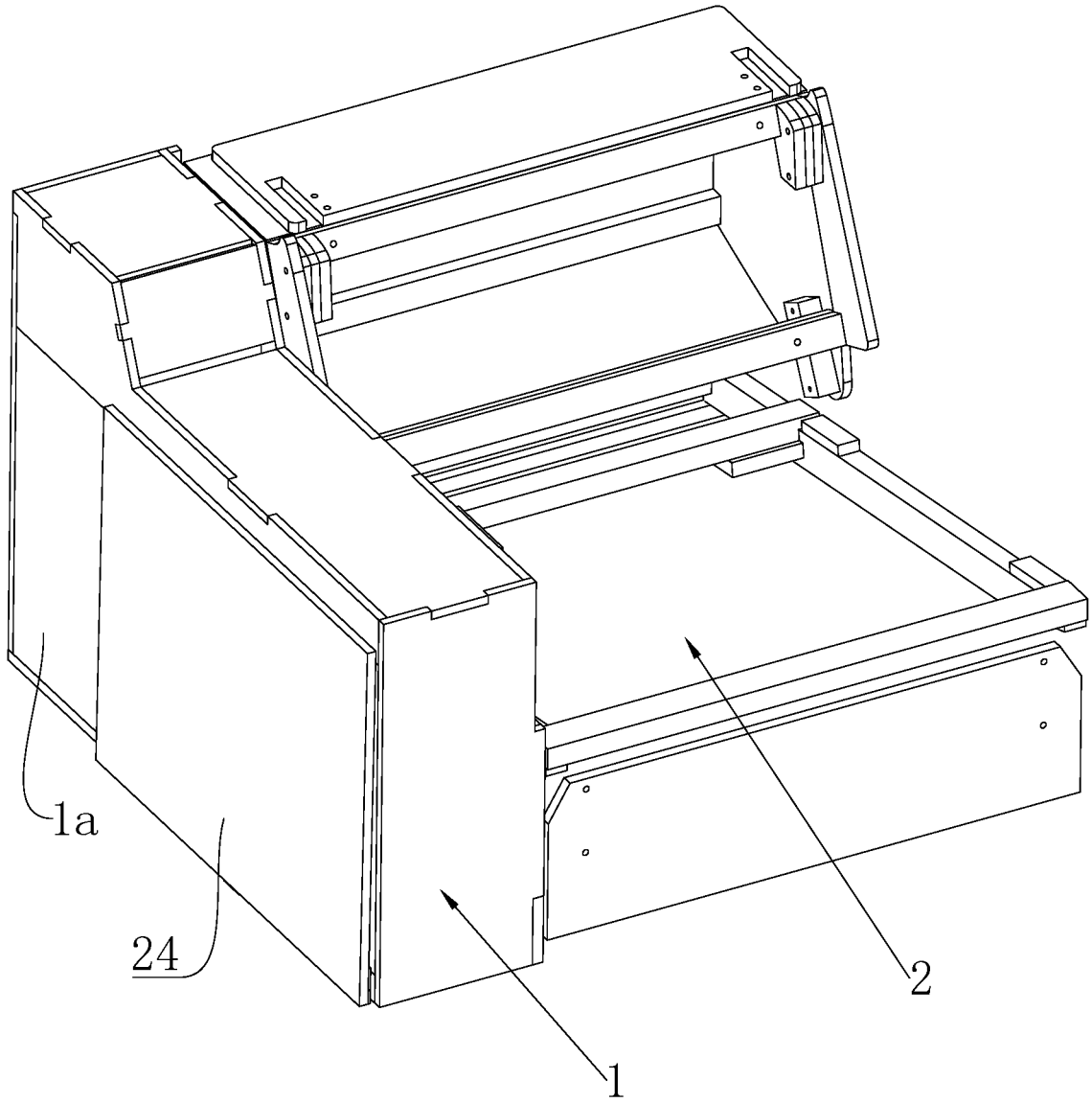
FIG. 7 is a three-dimensional schematic view of a structure of a movable function rack in a hidden position according to an embodiment of the disclosure.
Figure 8:
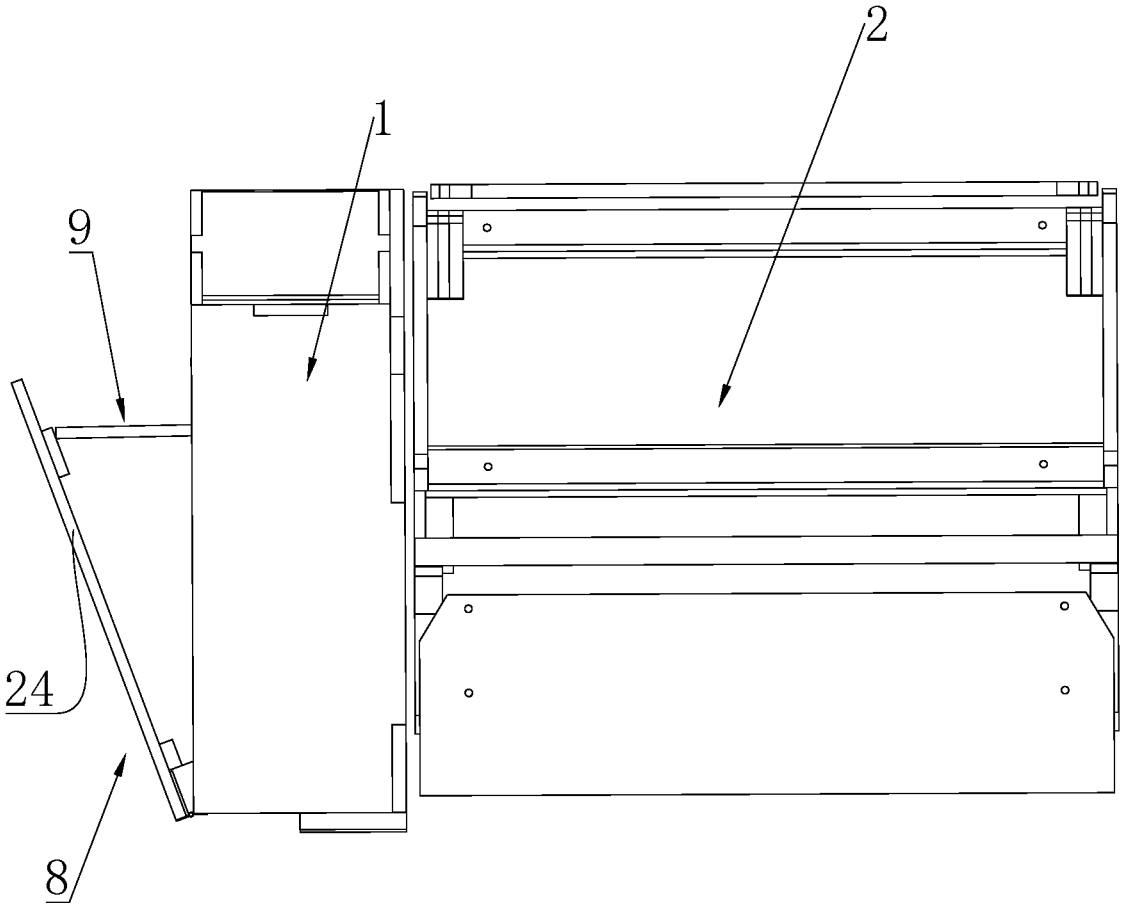
FIG. 8 is a three-dimensional schematic front view of a structure when the movable function rack is in a use position according to an embodiment of the disclosure.
Figure 9:
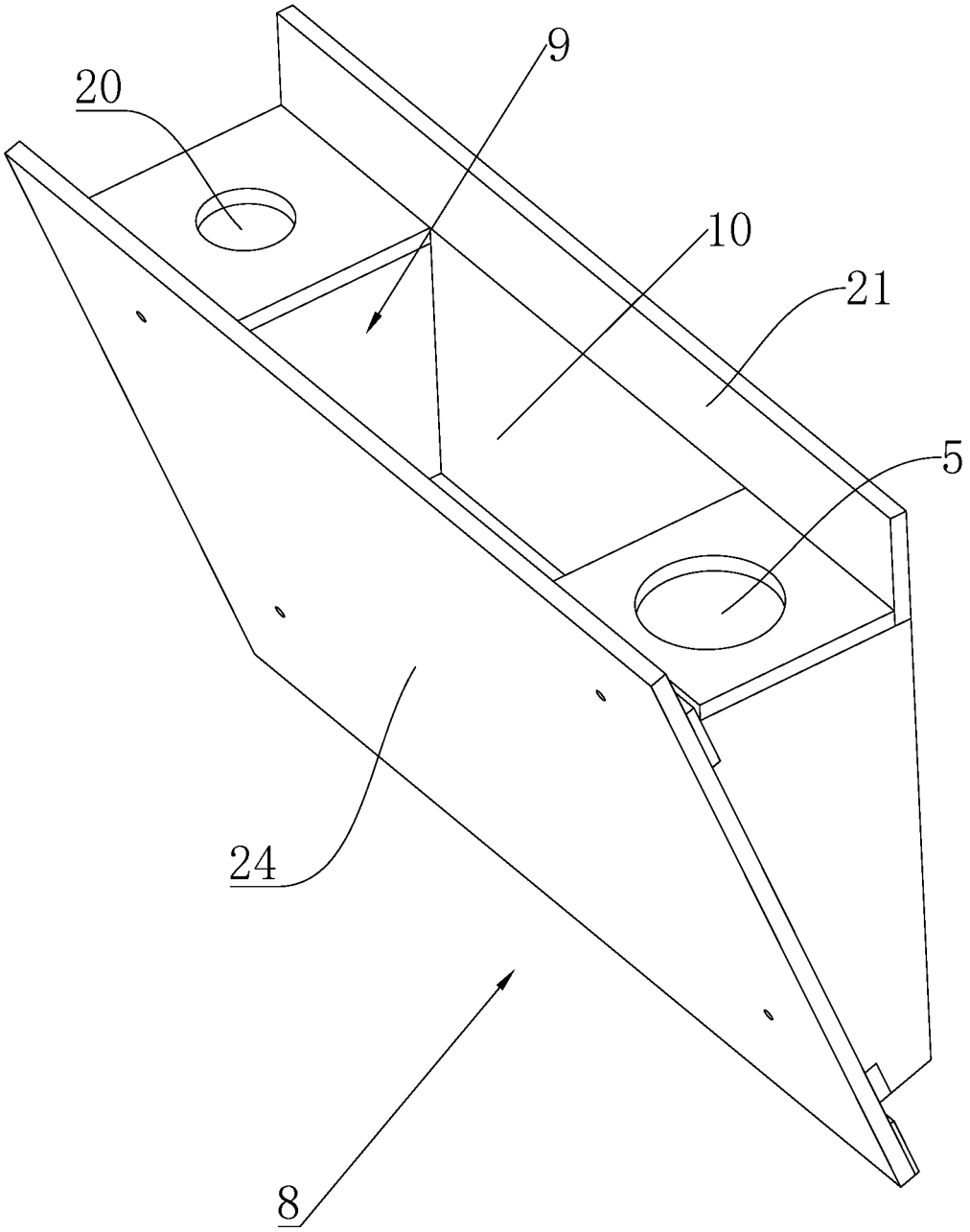
FIG. 9 is a three-dimensional schematic view of the structure of the movable function rack according to an embodiment of the disclosure.
Figure 10:
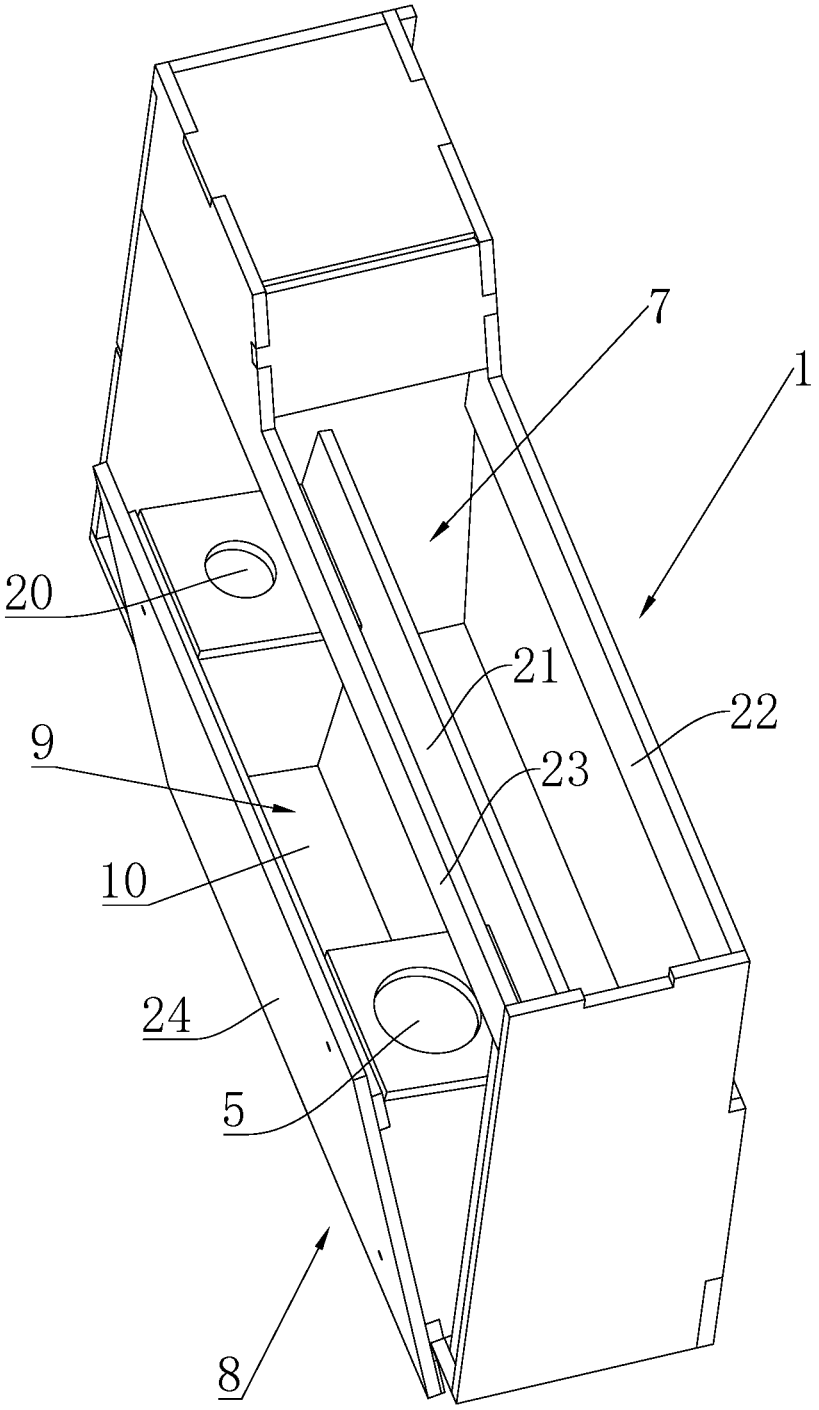
FIG. 10 is a three-dimensional schematic view of the structure of the movable function rack limited in an accommodating groove according to an embodiment of the disclosure.

As such, when the user sits on the sofa and the armrest of the sofa is required to allow a water cup, a mobile phone, or other objects to be placed thereon or is required to allow charging to be performed, as shown in FIG. 1 and FIG. 8, at this time, the movable function rack 8 is rotated outwards around the armrest assembly 1 to the use position. Herein, the convex plate 21 may abut against the outer restricting plate 23 to make the movable function rack 8 reach the maximum angle of rotation. The movable function rack 8 may be kept in this position, so that the function table 9 is exposed, and the upper surface of the function table 9 is in a horizontal state so that the user may use the function table 9 conveniently. As shown in FIG. 7, when the user needs to hide the movable function rack 8, the user may push the movable function rack 8 to rotate inwards, so that the movable function rack 8 is located in the accommodating groove 7 as a whole. The outer covering lid 24 may be attached to the outer side wall 1*a* of the armrest assembly 1, and the movable function rack 8 is completely hidden in the armrest assembly 1. There is no difference in appearance between this sofa and a general sofa.

Further, in the multifunctional sofa, finally the outer cover 6 and the cupholder 4 may be covered with decorative objects consistent with the surface leather of the sofa, and the movable function rack 8 may also be covered with decorative objects. As such, friction is provided between the outer cover 6 and the cupholder 4 when the outer cover 6 rotates, and friction is also provided when the movable function rack 8 rotates, so that favorable friction damping is provided when the user uses the sofa. Further, compared with a conventional sofa in which the cupholder is directly designed on the upper surface of the armrest of the sofa, in the multifunctional sofa provided by the disclosure, the cup slots 5 are designed to be hidden. The upper surface of the sofa may be designed in different styles according to the shape of the sofa without affecting the overall style of the sofa, is suitable for most of the sofas, and may be widely applied to actual processing and manufacturing.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A multifunctional sofa, comprising armrest assemblies located on both sides and at least two seat units, wherein a middle armrest is arranged between the at least two adjacent seat units, a front end of the middle armrest is provided with a cupholder, an upper end surface of the cupholder is provided with at least one cup slot for placing a cup, an outer cover is also provided outside the cupholder, the outer cover is capable of rotating relative to the cupholder to allow the at least one cup slot to be unfolded or folded, an accommodating groove is arranged in each of the armrest assemblies, a movable function rack being capable of rotating outwards relative to the armrest assembly is arranged in the accommodating groove, the movable function rack is provided with a function table, the function table is provided with at least one first function area and at least one second function area, the movable function rack has a hidden position and a use position, the movable function rack is entirely located in the accommodating groove in the hidden position, the movable function rack rotates outwards from the accommodating groove to protrude from the armrest assembly in the use position, and the function table is exposed outside, wherein an inner side of the movable function rack is provided with a convex plate extending upwards and protruding from the function table, inner and outer sides of the armrest assembly located at an upper end of the accommodating groove are respectively provided with an inner restricting plate and an outer restricting plate, a baffle abuts against the outer restricting plate when the movable function rack is in the use position, and the baffle abuts against the inner restricting plate when the movable function rack is in the hidden position.

2. The multifunctional sofa according to claim 1, wherein a shape of the outer cover is matched with a shape of the cupholder, the outer cover allows the cupholder to provide an unfolded state and a folded state, the cupholder is entirely hidden inside the outer cover in the folded state, and the outer cover rotates outwards to expose the at least one cup slot in the unfolded state.

3. The multifunctional sofa according to claim 2, wherein an upper end of the cupholder has a tray which is horizontally arranged, the at least one cup slot is arranged on the tray, an upper end of the outer cover is correspondingly provided with a covering lid, and the covering lid is in a horizontal state and is located directly above the tray to cover the at least one cup slot in the folded state.

4. The multifunctional sofa according to claim 3, wherein a front end of the cupholder has a limiting plate protruding upwards from the tray, a rear end of the cover lid is correspondingly provided with a baffle protruding downwards, and the outer cover rotates outwards until the limiting plate abuts against the baffle in the unfolded state.

5. The multifunctional sofa according to claim 1, wherein the function table is located at an upper end of the movable function rack, the first function area is provided with a cup slot for placing a cup, and the second function area is provided with a storage groove.

6. The multifunctional sofa according to claim 5, wherein the cup slot and the storage groove are arranged on the function table in a length direction of the movable function rack, the function table is provided with a charging slot, the charging slot is configured to allow a wireless charging pad to be installed, and the storage groove is located between the cup slot and the charging slot.

7. The multifunctional sofa according to claim 1, wherein a longitudinal section of the movable function rack is triangular, the function table is located at an upper end of the movable function rack, the function table is arranged in a length direction of the armrest assembly, and an upper surface of the function table is in a horizontal state in the use position.

8. The multifunctional sofa according to claim 1, wherein an outer side of the movable function rack is provided with an outer side plate, and the outer side plate is attached to an outer side wall of the armrest assembly to cover the accommodating groove in the hidden position.

9. The multifunctional sofa according to claim 1, wherein a bottom of the outer cover and the cupholder are rotatably matched through a hinge, and a bottom of the movable function rack and the armrest assembly are rotatably matched through the hinge.

10. A multifunctional sofa, comprising armrest assemblies located on both sides and at least two seat units, wherein a middle armrest is arranged between the at least two adjacent seat units, a front end of the middle armrest is provided with a cupholder, an upper end surface of the cupholder is provided with at least one cup slot for placing a cup, an outer cover is also provided outside the cupholder, the outer cover is capable of rotating relative to the cupholder to allow the at least one cup slot to be unfolded or folded, an accommodating groove is arranged in each of the armrest assemblies, a movable function rack being capable of rotating outwards relative to the armrest assembly is arranged in the accommodating groove, the movable function rack is provided with a function table, the function table is provided with at least one first function area and at least one second function area, the movable function rack has a hidden position and a use position, the movable function rack is entirely located in the accommodating groove in the hidden position, the movable function rack rotates outwards from the accommodating groove to protrude from the armrest assembly in the use position, and the function table is exposed outside, wherein a shape of the outer cover is matched with a shape of the cupholder, the outer cover allows the cupholder to provide an unfolded state and a folded state, the cupholder is entirely hidden inside the outer cover in the folded state, and the outer cover rotates outwards to expose the at least one cup slot in the unfolded state;

an upper end of the cupholder has a tray which is horizontally arranged, the at least one cup slot is arranged on the tray, an upper end of the outer cover is correspondingly provided with a covering lid, and the covering lid is in a horizontal state and is located directly above the tray to cover the at least one cup slot in the folded state; and a front end of the cupholder has a limiting plate protruding upwards from the tray, a rear end of the cover lid is correspondingly provided with a baffle protruding downwards, and the outer cover rotates outwards until the limiting plate abuts against the baffle in the unfolded state.

* * * * *